US011441762B1

(12) United States Patent
McRae

(10) Patent No.: US 11,441,762 B1
(45) Date of Patent: Sep. 13, 2022

(54) ILLUMINATED SHADE OR SCREEN ASSEMBLY

(71) Applicant: National Christmas Products LLC, Cranford, NJ (US)

(72) Inventor: Michael M. McRae, Ormond Beach, FL (US)

(73) Assignee: National Christmas Products LLC, Cranford, NJ (US)

( * ) Notice: Subject to any disclaimer, the term of this patent is extended or adjusted under 35 U.S.C. 154(b) by 0 days.

(21) Appl. No.: 17/488,868

(22) Filed: Sep. 29, 2021

Related U.S. Application Data

(63) Continuation of application No. 17/227,656, filed on Apr. 12, 2021, now Pat. No. 11,226,089.

(51) Int. Cl.

| | |
|---|---|
| ***F21V 23/00*** | (2015.01) |
| ***E06B 9/42*** | (2006.01) |
| ***F21V 23/04*** | (2006.01) |
| ***E04F 10/06*** | (2006.01) |
| ***F21Y 115/10*** | (2016.01) |
| ***E06B 9/24*** | (2006.01) |

(52) U.S. Cl.
CPC ..... *F21V 23/002* (2013.01); *E04F 10/0666* (2013.01); *E06B 9/42* (2013.01); *F21V 23/003* (2013.01); *F21V 23/0435* (2013.01); *E06B 2009/247* (2013.01); *F21Y 2115/10* (2016.08)

(58) Field of Classification Search
CPC .. F21V 23/002; F21V 23/003; F21V 23/0435; E04F 10/0666; E06B 9/42
USPC ..... 362/190
See application file for complete search history.

(56) References Cited

U.S. PATENT DOCUMENTS

| | | | | |
|---|---|---|---|---|
| 9,506,633 | B2 * | 11/2016 | Tischler | F21V 7/00 |
| 10,976,014 | B1 * | 4/2021 | Zhang | A41D 27/085 |
| 2013/0235558 | A1 * | 9/2013 | Zhou | E04F 10/0625 239/208 |
| 2013/0284234 | A1 * | 10/2013 | Funayama | H01L 31/048 136/251 |
| 2014/0198505 | A1 * | 7/2014 | Yan | G09F 9/301 362/249.04 |
| 2014/0262078 | A1 * | 9/2014 | Colson | E06B 9/42 160/310 |
| 2014/0355266 | A1 * | 12/2014 | Hsue | G02F 1/0105 362/249.04 |
| 2014/0369033 | A1 * | 12/2014 | Palfreyman | G06F 1/1616 362/183 |
| 2015/0204496 | A1 * | 7/2015 | Cselenyi | F21S 9/02 362/249.04 |
| 2018/0142517 | A1 * | 5/2018 | Shinozaki | E06B 9/42 |

* cited by examiner

*Primary Examiner* — Bryon T Gyllstrom
(74) *Attorney, Agent, or Firm* — Ellenoff Grossman & Schole LLP; James M. Smedley; Alex Korona

(57) ABSTRACT

An apparatus is disclosed. The apparatus has a sheet member, a support assembly including a movable, elongated member that is attached to a first end portion of the sheet member, an end assembly attached to a second end portion of the sheet member, and a plurality of lighting devices attached to the sheet member. The plurality of lighting devices is a plurality of flat panel lighting devices.

19 Claims, 5 Drawing Sheets

ILLUMINATED SHADE OR SCREEN ASSEMBLY

CROSS-REFERENCE TO RELATED APPLICATIONS

This application is a continuation of U.S. nonprovisional patent application Ser. No. 17/227,656 filed on Apr. 12, 2021, and entitled "Illuminated Shade or Screen Assembly," the entire disclosure of which is incorporated herein by reference.

FIELD OF THE INVENTION

The present invention generally relates to a shade or screen assembly and, in particular, to an illuminated shade or screen assembly.

BACKGROUND OF THE INVENTION

Conventional products that include lighting devices typically use relatively thick or bulky lighting configurations. For example, the relatively thick and bulky lighting devices used in conventional products typically cause use of those products to be avoided for certain functions or purposes. For example, conventional rollup shades typically do not include lighting devices because relatively bulky conventional lighting configurations negatively impact a rollup function of these types of shades.

Conventional products including known lighting device configurations are also not typically used in many outdoor applications because of the relatively thick and bulky configurations of the lighting devices.

The exemplary disclosed system, apparatus, and method are directed to overcoming one or more of the shortcomings set forth above and/or other deficiencies in existing technology.

SUMMARY OF THE INVENTION

In one exemplary aspect, the present disclosure is directed to an apparatus. The apparatus includes a sheet member, a support assembly including a movable, elongated member that is attached to a first end portion of the sheet member, an end assembly attached to a second end portion of the sheet member, and a plurality of lighting devices attached to the sheet member. The plurality of lighting devices is a plurality of flat panel lighting devices.

In another exemplary aspect, the present disclosure is directed to a method. The method includes providing a sheet member including a plurality of flat panel lighting devices, attaching a first end portion of the sheet member to a rotatable member of a support assembly, attaching a second end portion of the sheet member to an end assembly, electrically connecting the plurality of flat panel lighting devices to a control electronics device disposed in the end assembly, and selectively rolling up the sheet member including the plurality of flat panel lighting devices around the rotatable member.

DETAILED DESCRIPTION AND INDUSTRIAL APPLICABILITY

The exemplary disclosed system, apparatus, and method may include a shade or screen assembly. The exemplary disclosed shade or screen assembly may be a rollup shade or screen assembly. The exemplary disclosed shade or screen assembly may be an outdoor shade or screen.

Figure 1:
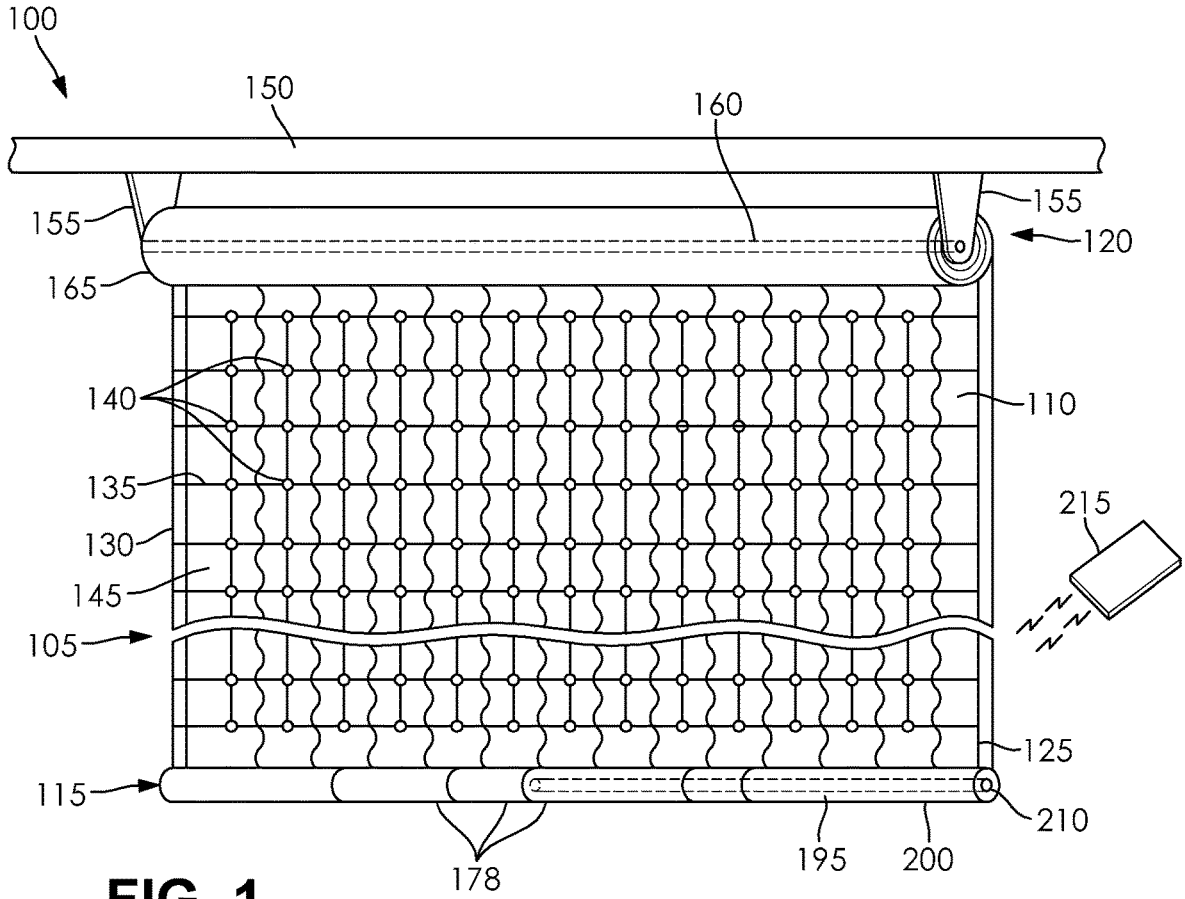
FIG. 1 illustrates a perspective view of at least some exemplary embodiments of the present disclosure.

FIG. 1 illustrates an exemplary system 100. System 100 may include a shade or screen assembly 105 that may include a member 110. Member 110 may be an elongated member. Member 110 may be a sheet member. Member 110 may be a flexible, flat member. Member 110 may be a shade, a screen, a blind, an awning, a canopy, a partition, a room divider, a windbreak, a curtain, a privacy screen, an arras, or any other suitable type of shade or screen. Shade or screen assembly 105 may be an illuminated shade or screen assembly. Shade or screen assembly 105 may also include an end assembly 115 that may be attached to a first end portion (e.g., a bottom end portion) of member 110. Shade or screen assembly 105 may further include a support assembly 120 that may be attached to a second end portion (e.g., a top end portion) of member 110.

Member 110 may be formed from any suitable material for forming a shade or screen such as, for example, polyester, cotton, linen, PVC, vinyl, bamboo, any suitable textile material, any suitable plastic material, flexible metal material, and/or any other suitable material. For example, member 110 may be formed from any suitable flexible material for being rolled up in a rollup shade or screen configuration for example as illustrated in FIG. 1.

A conductor 125 may be disposed at a first side portion of member 110 and a conductor 130 may be disposed at a second side portion of member 110. For example, conductors 125 and 130 may be disposed at opposite sides of member 110. Conductors 125 and 130 may be attached to member 110 by any suitable technique such as, for example, via adhesive, via stitching, being disposed in or integrally formed with member 110, and/or by any other suitable technique. Conductors 125 and 130 may be any suitable members for conducting electricity such as strip conductors. Conductors 125 and 130 may be thin, flexible conductors. Conductors 125 and 130 may be flexible ribbon conductors. Conductors 125 and 130 may be coated or covered with an insulation layer that may be formed from any suitable insulator material (e.g., plastic). For example as described below regarding FIG. 4B, the insulation layer may be disposed behind conductors 125 and 130. Conductor 125 may be a positive power strip and conductor 130 may be a negative power strip. Conductors 125 and 130 may be electrically connected to end assembly 115 for example as described herein.

Figure 2:
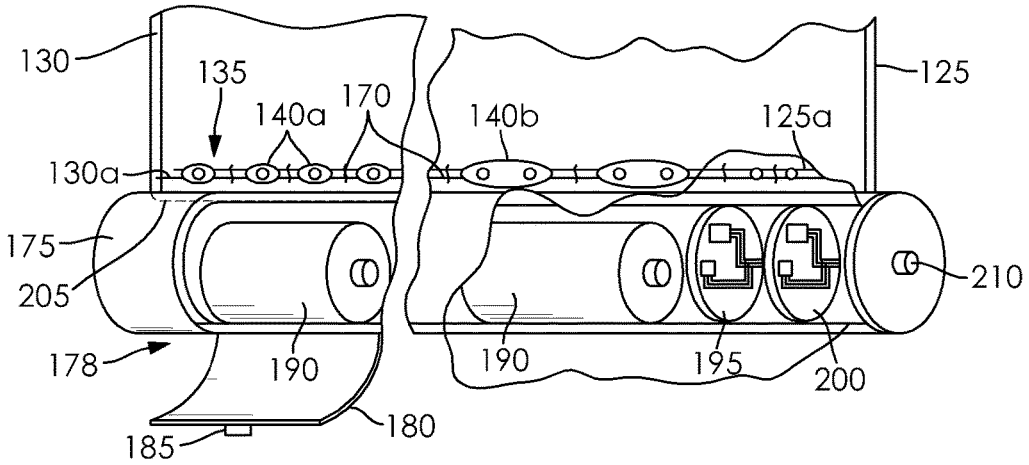
FIG. 2 illustrates a perspective view of at least some exemplary embodiments of the present disclosure.

One or more electrical components 135 may be disposed at member 110 for example as illustrated in FIG. 1 or in any other desired configuration. Electrical components 135 may include any suitable lighting elements 140. Lighting elements 140 may be any suitable flat panel lighting devices. Lighting elements 140 may be any suitable flat panel display elements. Lighting elements 140 may be LEDs. Lighting elements 140 may include microscopic LEDs. Lighting elements 140 may be micro-LEDs. For example, electrical component 135 may be a micro-LED string light. Lighting elements 140 may also be mini-LEDs, OLEDs, and/or any other suitable type of lighting device. Electrical components 135 may be electrically attached between conductors 125 and 130. As illustrated in FIG. 2, electrical component 135 may be electrically connected to conductor 125 via a lead 125*a* and may be electrically connected to conductor 130 via a lead 130*a*. For example, electrical components 135 may be electrically attached in parallel between conductors 125 and 130.

In at least some exemplary embodiments and as illustrated in FIG. 2, electrical component 135 may include any suitable type of LEDs (e.g., and/or one or more types of LEDs). For example, electrical component 135 may include lighting elements 140*a* that may be single or dual-color (e.g., or multi-color) micro-LEDs. Also for example, electrical component 135 may include lighting elements 140*b* that may be single or dual-color (e.g., or multi-color) micro-LEDs including extended clear epoxy (e.g., covered with and/or including extended clear epoxy).

Returning to FIG. 1, electrical components 135 may be attached to member 110 similarly to conductors 125 and 130. Electrical components 135 may be included in a covering that may be attached to member 110 or may be integrally formed in member 110. For example, electrical components 135 including lighting elements 140, 140*a*, and/or 140*b* may be included in a single epoxy layer (e.g., or any other suitable material such as any suitable plastic material, polymer, and/or adhesive) or covering that is applied or attached to member 110. In at least some exemplary embodiments and as illustrated in FIG. 2, electrical components 135 (e.g., including lighting elements 140, 140*a*, and/or 140*b*) may be stitched to slots formed in member 110 via stitching (e.g., stitches 170) that may be formed from clear or opaque material.

Returning to FIG. 1, member 110 may serve as an illuminated shade or screen. For example, member 110 may provide an illuminated shade or screen for use at nighttime (e.g., outdoors or indoors). Member 110 may also be used as a projector screen (e.g., on which to project television, movies, or other media). For example, member 110 may include an outer layer 145 on which media (e.g., images) may be projected. Outer layer 145 may be an opaque (e.g., slightly opaque) and/or tinted (e.g., slightly tinted) layer. Outer layer 145 may be a layer of insulation. Outer layer 145 may be attached or applied to member 110 similarly to conductors 125 and 130 and/or lighting elements 140, 140*a*, and 140*b*.

Support assembly 120 may mount shade or screen assembly 105 to any suitable location such as a support structure 150 (e.g., a ceiling, a wall, a stand, a portable assembly, or any other suitable structural assembly or member). Support assembly 120 may vertically mount or horizontally mount shade or screen assembly 105, mount shade or screen assembly 105 on an arch, and/or provide any other suitable mounting of shade or screen assembly 105. Support assembly 120 may fixedly or portably mount shade or screen assembly 105 to support structure 150. Support assembly 120 may include any suitable members for attaching shade or screen assembly 105 to support structure 150 such as, for example, support members 155 (e.g., members attached to support structure 150 and having apertures, protrusions, and/or hinges) that may rotatably support an elongated member 160 (e.g., a bar, dowel, rod, or other suitable elongated member) about which member 110 may be rolled. Elongated member 160 may be a rotatable, elongated member. For example, member 110 may be selectively rolled up so that a rollup portion 165 of member 110 may be wound or rolled around elongated member 160. Member 110 may thereby be a rollup shade or screen. Support assembly 120 may also include actuators, motors, and/or any other suitable mechanical and electro-mechanical components for selectively driving (e.g., rotating) elongated member 160 to roll up and roll down member 110. Support assembly 120 may also include any suitable mechanical assemblies to allow a user to selectively raise and lower member 100 manually to and from elongated member 160.

As illustrated in FIGS. 1 and 2, end assembly 115 may be an end pole or any other suitable type of member for attachment to member 110 (e.g., to a bottom portion of member 110). End assembly 115 may include a housing 175 forming one or more cavities (e.g., compartments 178) in which any suitable electrical components for controlling and operating shade or screen assembly 105 may be disposed such as power and control electronics. Housing 175 may include an access door 180 having a fastener 185 (e.g., latch) that may open and close to selectively provide access to one or more power sources 190. Power source 190 may be a battery such as a rechargeable or disposable battery. For example, power source 190 may be a nickel-metal hydride battery, a lithium-ion battery, an ultracapacitor battery, a Graphene battery, a lead-acid battery, and/or a nickel cadmium battery. A communication device (e.g., communication component 195) such as, for example, a receiver or a transceiver may be disposed in housing 175. One or more power sources 190 may also be disposed at any other suitable portion of shade or screen assembly 105 such as at support assembly 120 (e.g., disposed in a housing attached to support member 155).

A control electronics device such as a control electronics component 200 may also be disposed in housing 175. Control electronics component 200 may be a controller. Control electronics component 200 may include a computing device for controlling an operation of components of shade or screen assembly 105. Control electronics component 200 may, for example, include a processor (e.g., microprocessing logic control device) or board components. A lead 205 may electrically connect conductor 130 (e.g., a negative conductor) to control electronics component 200. One or more power sources 190 may be electrically connected to and may electrically power electrical components 135, communication component 195, and/or control electronics component 200. Electrical power and control signals may be transferred between control electronics component 200, electrical components 135, and/or power sources 190 via conductors 125 and 130. An actuator 210 may be disposed on or at housing 175. Actuator 210 may be any suitable switch or control device that may be actuated or manipulated by a user to provide input and/or to allow a user to give commands to control electronics component 200. For example, actuator 210 may be a power and sequence switch.

A user may also control shade or screen assembly 105 via a controller 215 for example as described below.

Controller 215 may be a user device. Controller 215 may be a remote control. Controller 215 may include similar components as communication component 195 (e.g., may be a transmitter or transceiver) and control electronics component 200. Controller 215 may also be any suitable user device such as, for example a mobile device (e.g., a smartphone, a tablet, a smartboard, and/or any suitable computer device), a computer keyboard and monitor (e.g., desktop or laptop), an audio-based device for entering input and/or receiving output via sound, a tactile-based device for entering input and receiving output based on touch or feel, a smart watch, Bluetooth headphones, a dedicated user device or interface designed to work specifically with other components of system 100, and/or any other suitable user device or interface. Controller 215 may include input/output arrangements that allow it to be connected (e.g., via wireless, Wi-Fi, Bluetooth, or any other suitable communication technique) to other components of system 100 (e.g., communication component 195). For example, controller 215 may control an operation of components (e.g., control electronics component 200) of system 100. System 100 may include one or more modules that may be partially or substantially entirely integrated with one or more components of system 100 such as, for example, control electronics component 200 and/or controller 215. For example, the one or more modules may include computer-executable code stored in non-volatile memory. The one or more modules may also operate using a processor (e.g., control electronics component 200 and/or controller 215). The one or more modules may store data and/or be used to control some or all of the exemplary disclosed actions and processes described herein. Controller 215 may communicate with any suitable components of system 100 (e.g., control electronics component 200 via communication component 195) via any suitable communication method such as, for example, wireless communication (e.g., CDMA, GSM, 3G, 4G, and/or 5G), direct communication (e.g., wire communication), Bluetooth communication coverage, Near Field Communication (e.g., NFC contactless communication), radio frequency communication (e.g., RF communication such as short-wavelength radio waves, e.g., UHF waves), and/or any other desired communication technique.

Figure 3:
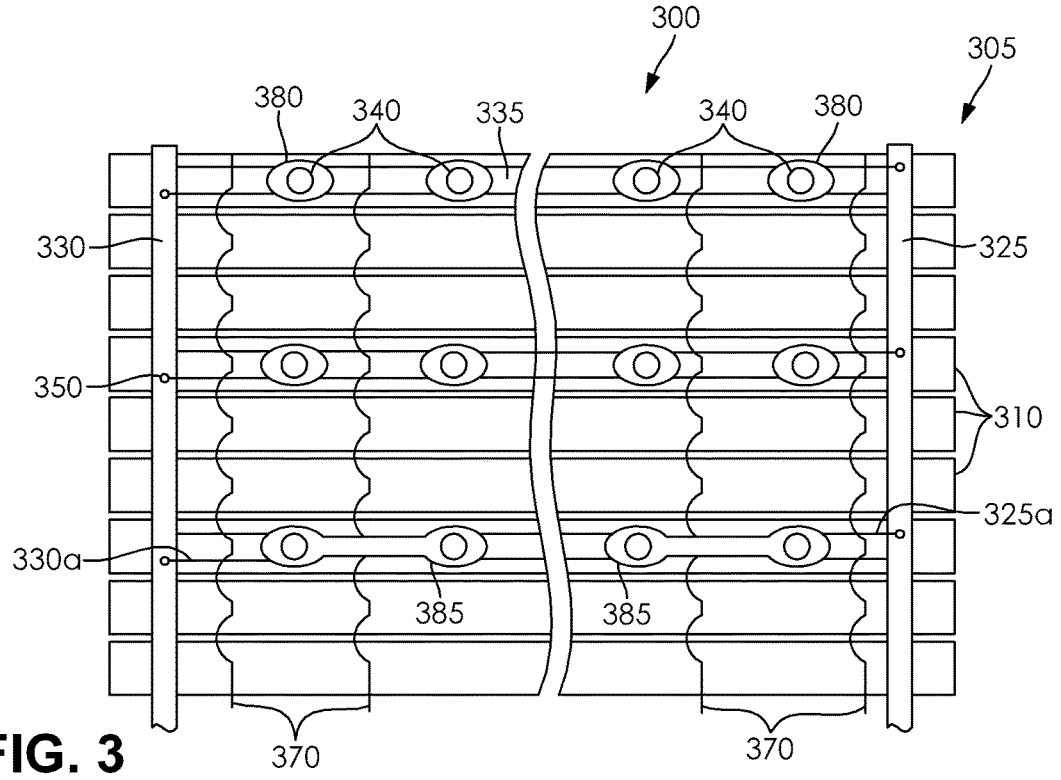
FIG. 3 illustrates a front view of at least some exemplary embodiments of the present disclosure.

FIG. 3 illustrates another exemplary embodiment of the exemplary disclosed system, apparatus, and method. System 300 may include a shade or screen assembly 305 that may be generally similar to shade or screen assembly 105. Shade or screen assembly 305 may include a member (e.g., a plurality of members 310) that may be formed similarly to member 110. In at least some exemplary embodiments, members 310 may be elongated members such as slats. For example, members 310 may be bamboo slats. Shade or screen assembly 305 may be a strip-type rollup shade or screen. In at least some exemplary embodiments, shade or screen assembly 305 may be a strip-type bamboo rollup shade or screen.

Shade or screen assembly 305 may include a conductor 325 that may be similar to conductor 125 and a conductor 330 that may be similar to conductor 130. In at least some exemplary embodiments, conductor 325 may be a positive conductor strip that may be covered with insulation. In at least some exemplary embodiments, conductor 330 may be a negative conductor strip that may be covered with insulation. For example, conductors 325 and 330 may be flexible, thin conductors.

Shade or screen assembly 305 may include a plurality of electrical components 335 that may be similar to electrical components 135. Electrical components 135 may be connected to conductors 325 and 330 via respective leads 325*a* (e.g., positive lead) and 330*a* (e.g., negative lead) similar to as described above regarding leads 125*a* and 130*a*. Electrical components 335 may be electrically connected to conductors 325 and 330 via contacts 350 (e.g., electrical contacts or contact points). Fasteners 370 may attach members 310 to each other. Fasteners 370 may be any suitable fasteners for attaching members 310 such as, for example, stitching, wires, cords, chains, and/or any other suitable mechanical attachments.

Electrical components 335 may include a plurality of lighting elements 340 that may be similar to lighting elements 140, 140*a*, and/or 140*b*. For example, lighting elements 340 may be micro-LEDs. Shade or screen assembly 305 may include insulation 380 that may be any suitable type of insulator material such as epoxy (e.g., a clear epoxy insulation layer) or any other suitable material such as any suitable plastic material, polymer, and/or adhesive. Shade or screen assembly 305 may also include insulation 385 that may be any suitable type of insulator material such as epoxy (e.g., an extended clear epoxy insulation layer) or any other suitable material such as any suitable plastic material, polymer, and/or adhesive.

Figures 4A, 4B:
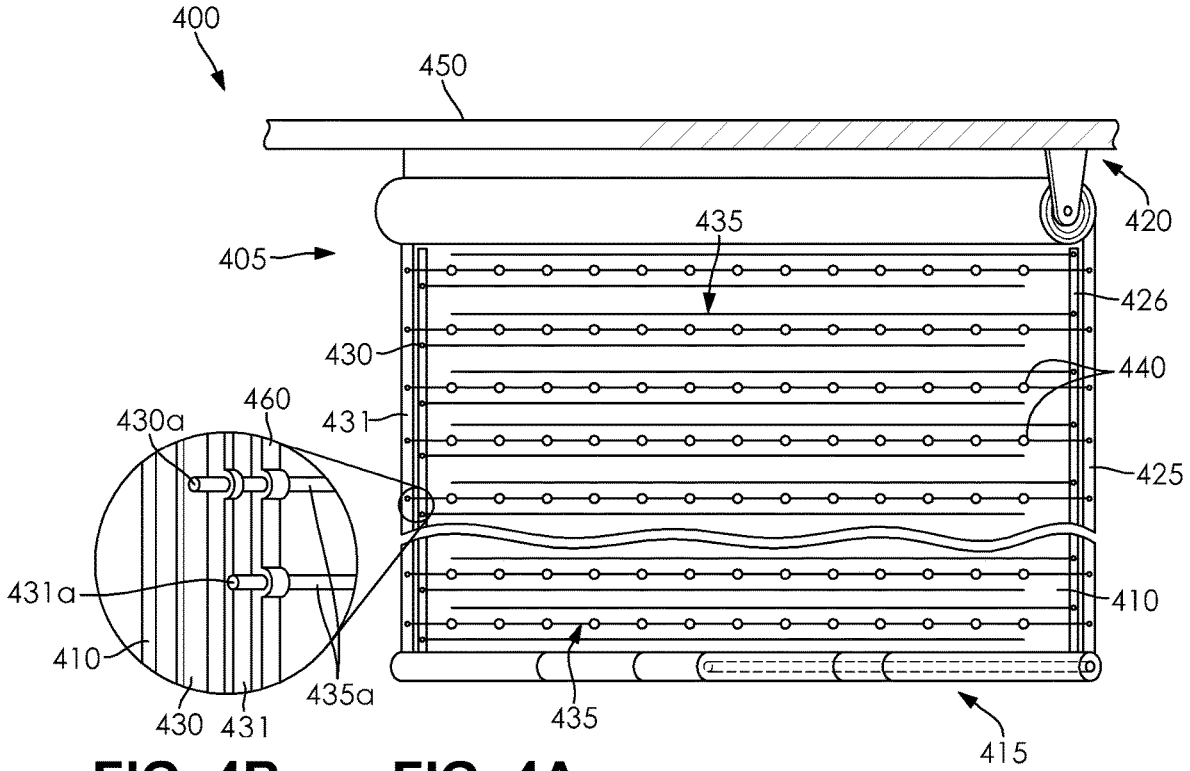
FIG. 4A illustrates a perspective view of at least some exemplary embodiments of the present disclosure.
FIG. 4B illustrates a sectional view of at least some exemplary embodiments of the present disclosure.

FIGS. 4A and 4B illustrate another exemplary embodiment of the exemplary disclosed system, apparatus, and method. System 400 may include a shade or screen assembly 405 that may be generally similar to shade or screen assembly 105. Shade or screen assembly 405 may include a member 410 that may be similar to member 110. Shade or screen assembly 405 may include a support assembly 420 that may be similar to support assembly 120 and that may attach shade or screen assembly 405 to a support structure 450 that may be similar to support structure 150. Shade or screen assembly 405 may include an end assembly 415 that may be similar to end assembly 115.

Shade or screen assembly 405 may include a plurality of conductive strips disposed at each side portion of member 410. For example, shade or screen assembly 405 may include a conductor 425 and a conductor 426 that may be similar to conductor 125, and a conductor 430 and a conductor 431 that may be similar to conductor 130. For example, conductors 425 and 426 may be positive conductors, and conductors 430 and 431 may be negative conductors.

Shade or screen assembly 405 may include a plurality of electrical components 435 that may be similar to electrical components 135. Electrical components 435 may be connected to conductors 425, 426, 430, and 431 via leads that may be similar to leads 325*a* or 330*a*. Electrical components 435 may be electrically disposed between conductors 425 and 430, between conductors 425 and 431, between conductors 426 and 430, and/or between conductor 426 and 431 (e.g., via contacts that may be similar to contacts 350). This may allow for a plurality of different combinations for electrical components 435 to be energized via the exemplary disclosed conductors.

Electrical components 435 may include a plurality of lighting elements 440 that may be similar to lighting elements 140, 140*a*, and/or 140*b*. For example, lighting elements 440 may be micro-LEDs. Lighting elements 440 may include micro-LEDs disposed in single bulb epoxy housings, multiple LEDs disposed in single bulbs epoxy housings, and/or single LEDs.

FIG. 4B illustrates a section view of shade or screen assembly 405 showing a connection of the exemplary disclosed electrical component and conductors. Leads 435*a* of electrical component 435 may electrically connect electrical component 435 to for example conductors 430 and 431. Leads 435*a* may be covered with insulation material, with the insulation material being removed at connections 430*a* and 431*a* that may be attached (e.g., spot-welded or attached by any other suitable technique) to conductors 430 and 431. Similar connections may be made at conductors 425 and 426. An insulation layer 460 may be disposed on electrical component 435 (e.g., including lighting elements 440) and/or conductors 430 and 431 (e.g., and/or conductors 425 and 426). Insulation layer 460 may be a relatively thin insulation layer. Insulation layer 460 may be a clear, slightly opaque, or slightly tinted insulation layer. Insulation layer 460 may be a flexible bonded layer of insulation. For example, insulation layer 460 may be slightly opaque or slightly tinted so as to reflect projected light on member 410 (e.g., a shade or screen) for example when lighting elements 440 are not energized. Leads 435*a* may extend through insulation layer 460.

Figure 5:
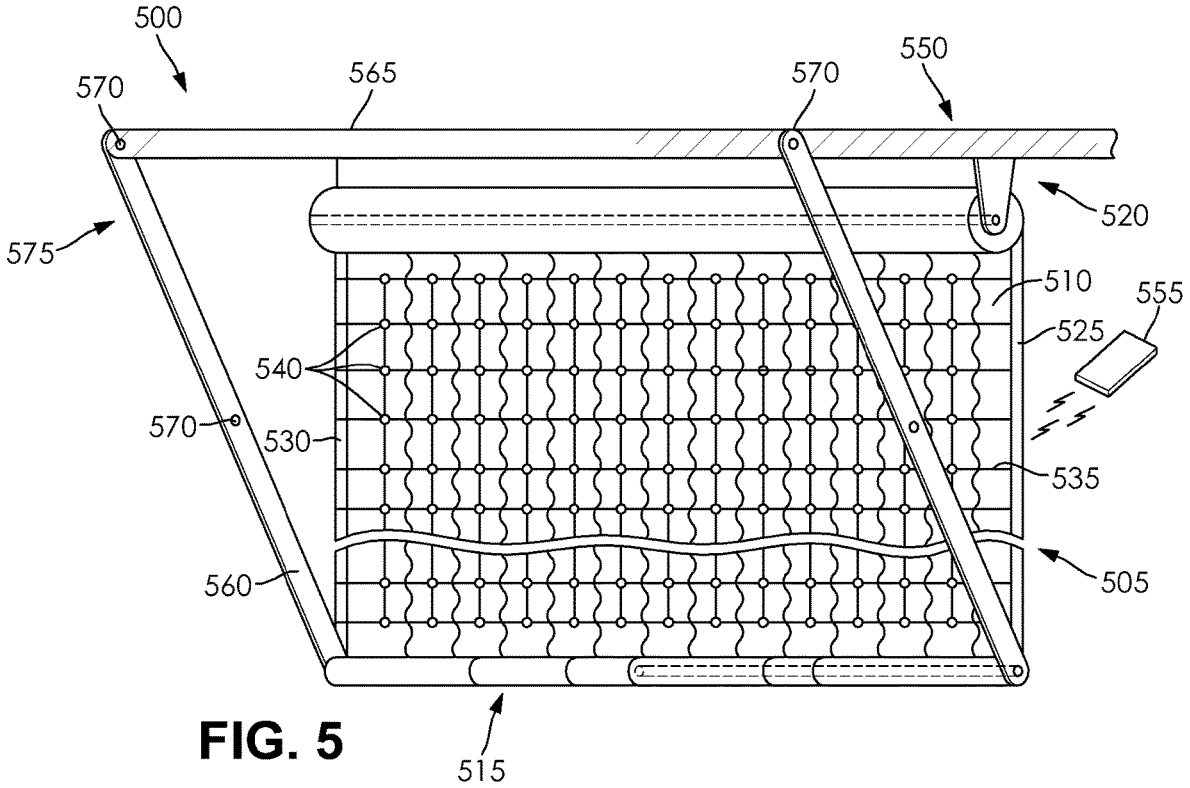
FIG. 5 illustrates a perspective view of at least some exemplary embodiments of the present disclosure.

FIG. 5 illustrates another exemplary embodiment of the exemplary disclosed system, apparatus, and method. System 500 may include a shade or screen assembly 505 that may be generally similar to shade or screen assembly 105. System 500 may be for example a rollup illuminated awning. Shade or screen assembly 505 may include a member 510 that may be similar to member 110. Shade or screen assembly 505 may include a support assembly 520 that may be similar to support assembly 120 and that may attach shade or screen assembly 505 to a support structure 550 that may be similar to support structure 150. Shade or screen assembly 505 may include an end assembly 515 that may be similar to end assembly 115.

Shade or screen assembly 505 may include a conductor 525 that may be similar to conductor 125 and a conductor 530 that may be similar to conductor 130. Shade or screen assembly 505 may include a plurality of electrical components 535 that may be similar to electrical components 135. Electrical components 535 may include a plurality of lighting elements 540 that may be similar to lighting elements 140, 140*a*, and/or 140*b*. For example, lighting elements 540 may be micro-LEDs. System 500 may also include a controller 555 that may be similar to controller 215.

System 500 may for example include member 510 (e.g., an illuminated shade or screen) that may be an awning disposed over a window, a doorway, or any suitable wall surface or other solid structure. System 500 may include a plurality of support members 560 that may support a cover member 565. Support members 560 may include one or more hinges 570 that allow the support members 560 to selectively fold or collapse. For example, support members 560 may be rotatably connected to cover member 565 via hinges 570. Support members 560 may serve as struts that support cover member 565 that may be a roof or canopy. Support members 560 and cover member 565 may comprise an awning assembly 575. Support members 560 and cover member 565 may be rotated relative to each other and to shade or screen assembly 505 in order to selectively extend out or collapse awning assembly 575.

Figure 6:
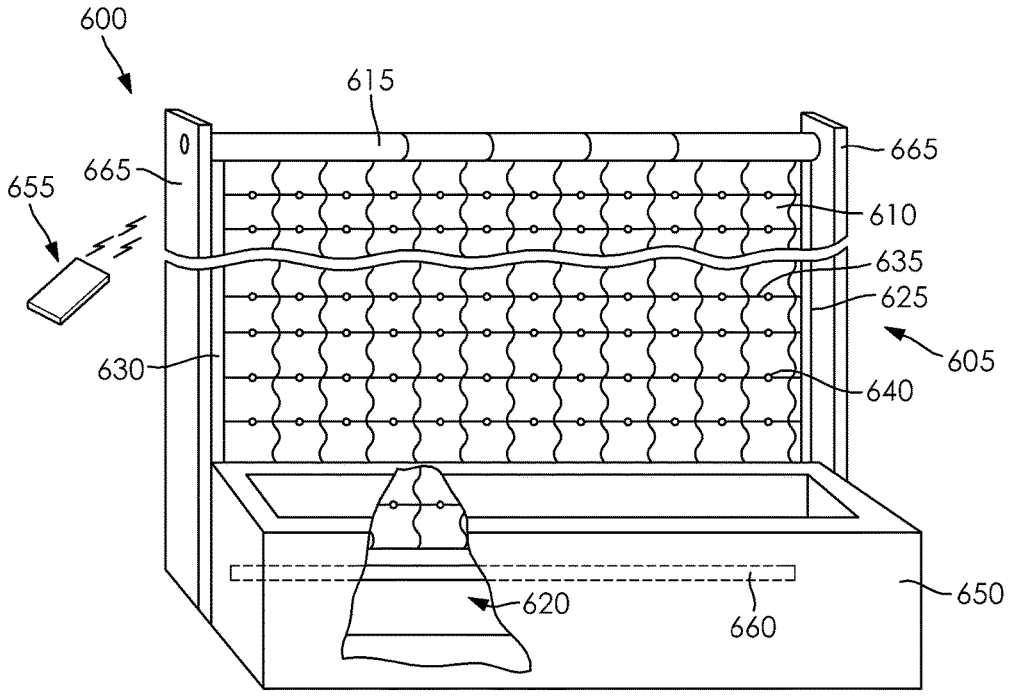
FIG. 6 illustrates a perspective view of at least some exemplary embodiments of the present disclosure.

FIG. 6 illustrates another exemplary embodiment of the exemplary disclosed system, apparatus, and method. System 600 may include a shade or screen assembly 605 that may be generally similar to shade or screen assembly 105. System 600 may be for example a pull-up type shade or screen. Shade or screen assembly 605 may include a member 610 that may be similar to member 110. Shade or screen assembly 605 may include an end assembly 615 that may include components similar to as described above regarding end assembly 115.

Shade or screen assembly 605 may include a conductor 625 that may be similar to conductor 125 and a conductor 630 that may be similar to conductor 130. Shade or screen assembly 605 may include a plurality of electrical components 635 that may be similar to electrical components 135. Electrical components 635 may include a plurality of lighting elements 640 that may be similar to lighting elements 140, 140*a*, and/or 140*b*. For example, lighting elements 640 may be micro-LEDs. System 600 may also include a controller 655 that may be similar to controller 215.

Shade or screen assembly 605 may include a support assembly 620 that may be similar to support assembly 120. Support assembly 620 may be disposed within, at, or on a support structure 650. Support assembly 620 may include an elongated member 660 that may be similar to elongated member 160 about which member 610 may be selectively rolled or wound. Support structure 650 may be for example a planter, a bench, or any other suitable support structure. System 600 may include a plurality of support members 665. Support members 665 may be for example telescopic support members that may be selectively extended from (and locked into place) and retracted toward support structure 650. For example, support members 665 may be extended and retracted to selectively extend shade or screen assembly 605 up from support structure 650. Shade or screen assembly 605 may be selectively stored or stowed within support structure 650 (e.g., when support members 665 are retracted). System 600 may thereby provide shade or screen assembly 605 that may be a pull-up type shade or screen attached to support structure 650 that may be a planter or any other structure such as a bench.

Figure 7:
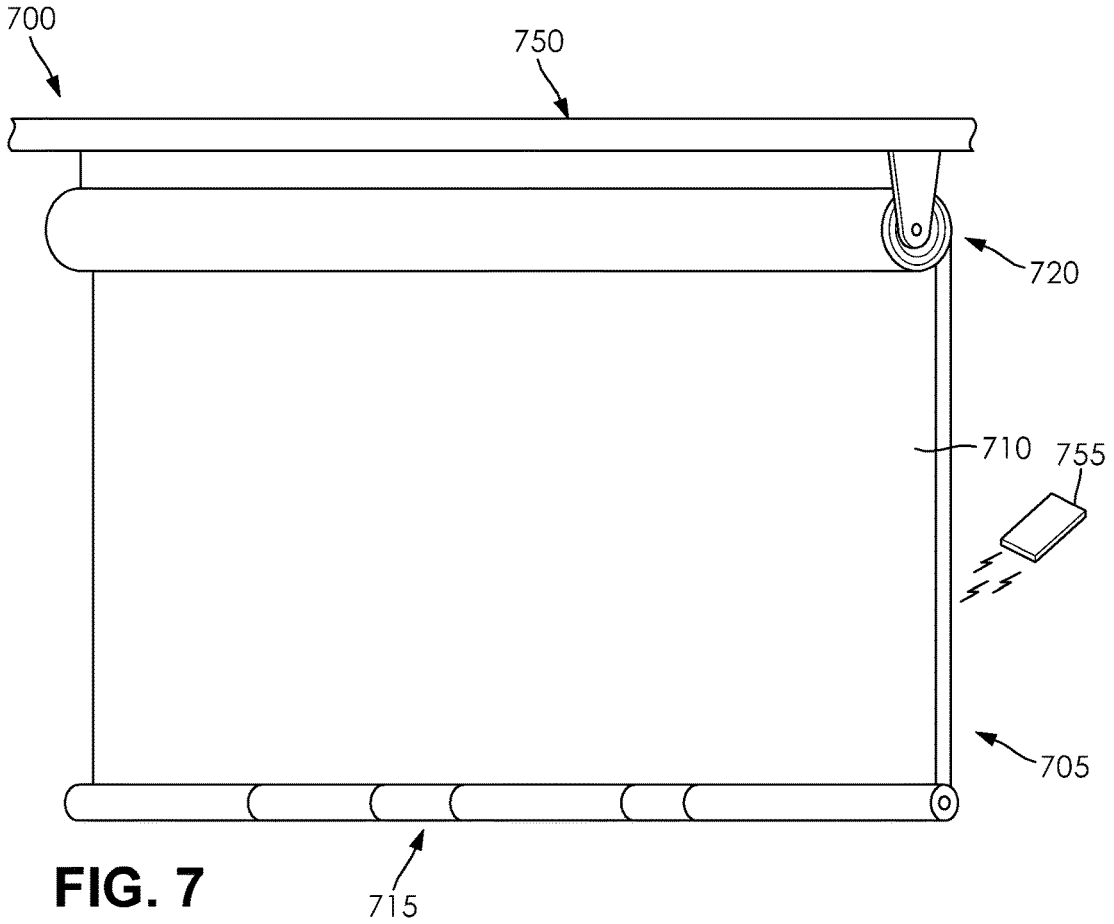
FIG. 7 illustrates a perspective view of at least some exemplary embodiments of the present disclosure.

FIG. 7 illustrates another exemplary embodiment of the exemplary disclosed system, apparatus, and method. System 700 may include a shade or screen assembly 705 that may be generally similar to shade or screen assembly 105 and that may include the exemplary disclosed electrical components and lighting elements. Shade or screen assembly 705 may include a member 710 that may be similar to member 110. Shade or screen assembly 705 may include a support assembly 720 that may be similar to support assembly 120 and that may attach shade or screen assembly 705 to a support structure 750 that may be similar to support structure 150. Shade or screen assembly 705 may include an end assembly 715 that may be similar to end assembly 115. System 700 may also include a controller 755 that may be similar to controller 215.

As illustrated in FIG. 7, shade or screen assembly 705 may provide any suitable type or number of display patterns including alternating and/or variable (e.g., changing) patterns of the exemplary disclosed lighting elements. For example, shade or screen assembly 705 may display a white pattern or field that may change to a flag, a variable color display (e.g., a color-changing display), and/or white illumination (e.g., white LEDs) for general illumination with a varying intensity (e.g., selectively varied to provide illumination for any desired purpose, mood, or setting). For example, lighting elements (e.g., micro-LEDs) of shade or screen assembly 705 may energize to provide a pattern or display that alternates (e.g., alternates with a varying color pattern).

Figure 8:
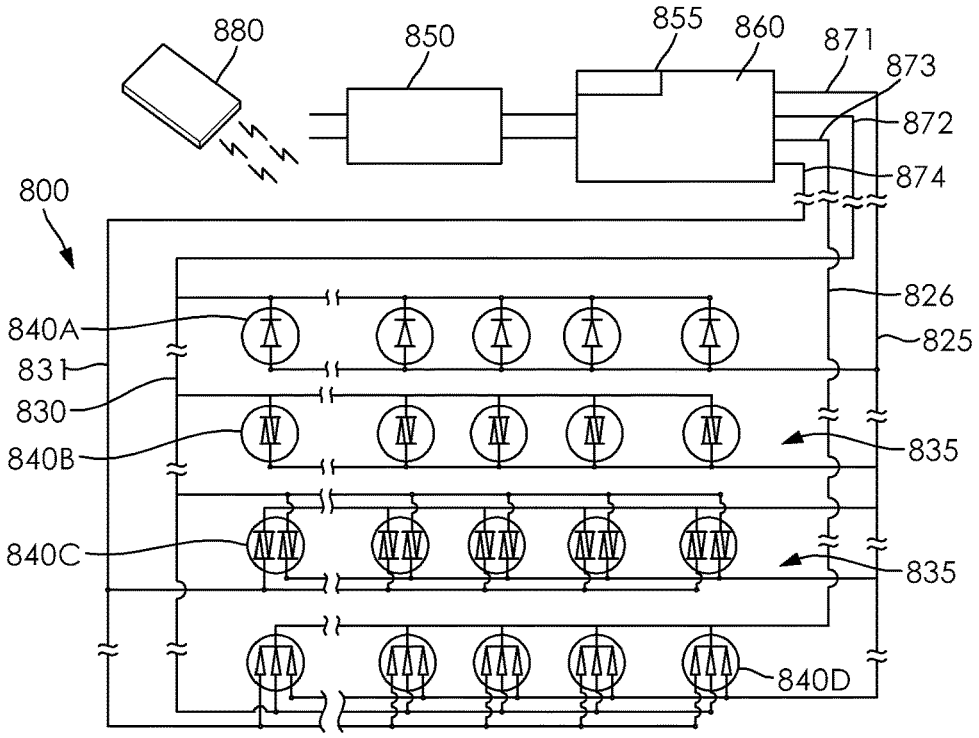
FIG. 8 illustrates a schematic view of at least some exemplary embodiments of the present disclosure.

FIG. 8 illustrates an exemplary electrical configuration of the exemplary disclosed system, apparatus, and method. System 800 may be an electrical system for any of the exemplary disclosed shade or screen assemblies (e.g., shade or screen assembly 105, shade or screen assembly 305, shade or screen assembly 405, shade or screen assembly 505, shade or screen assembly 605, or shade or screen assembly 705). System 800 may include a plurality of conductors 825, 826, 830, and 831 that may be similar to conductors 425, 426, 430, and 431. System 800 may also include a plurality of electrical components 835 that may be similar to electrical components 135. Electrical components 835 may be connected to conductors 825, 826, 830, and 831 via leads that may be similar to leads 325*a* or 330*a*. Electrical components 835 may be electrically disposed between conductors 825 and 830 (e.g., as illustrated in FIG. 8), between conductors 825 and 831, between conductors 826 and 830, and/or between conductors 826 and 831 (e.g., as illustrated in FIG. 8).

Electrical components 835 may include a plurality of lighting elements 840*a*, 840*b*, 840*c*, and 840*d* that may be similar to any of the exemplary disclosed lighting elements described herein. For example, lighting elements 840*a* may be micro-LEDs that may be electrically connected between conductors 825 and 830, lighting elements 840*b* may be back-to-back micro-LEDs that may be electrically connected between conductors 825 and 830, lighting elements 840*c* may be double back-to-back micro-LEDs that may be electrically connected between conductors 825 and 830, and lighting elements 840*d* may be triple micro-LEDs that may be electrically connected between conductors 826 and 831.

System 800 may include a power source 850 that may be similar to power source 190, a communication component 855 that may be similar to communication component 195, and a control electronics component 860 that may be similar to control electronics component 200. Control electronics component 860 may include a plurality of outputs that may be electrically connected to electrical components 835 via conductors 825, 826, 830, and 831 for controlling and/or powering lighting elements 840*a*, 840*b*, 840*c*, and 840*d*. For example, an output 871 may be electrically connected to conductor 825, an output 872 may be electrically connected to conductor 830, an output 873 may be electrically connected to conductor 826, and an output 874 may be electrically connected to conductor 831. System 800 may also include a controller 880 that may be similar to controller 215.

As illustrated in FIG. 8, electrical connections for lighting elements 840*a* (e.g., a single parallel-connected micro-LED row), lighting elements 840*b* (e.g., dual back-to-back parallel row of micro-LEDs), lighting elements 840*c* (e.g., double-connected two sets of back-to-back micro-LEDs in parallel-connected single bulb housings), and lighting elements 840*d* (e.g., set of three micro-LEDs with a common return connection connected in parallel with single bulb housings), may be connected to control electronics component 860 with communication component 855 that may receive power (e.g., from power source 850 such as an AC to DC, hi to low voltage adapter, or a battery source).

Figure 9:
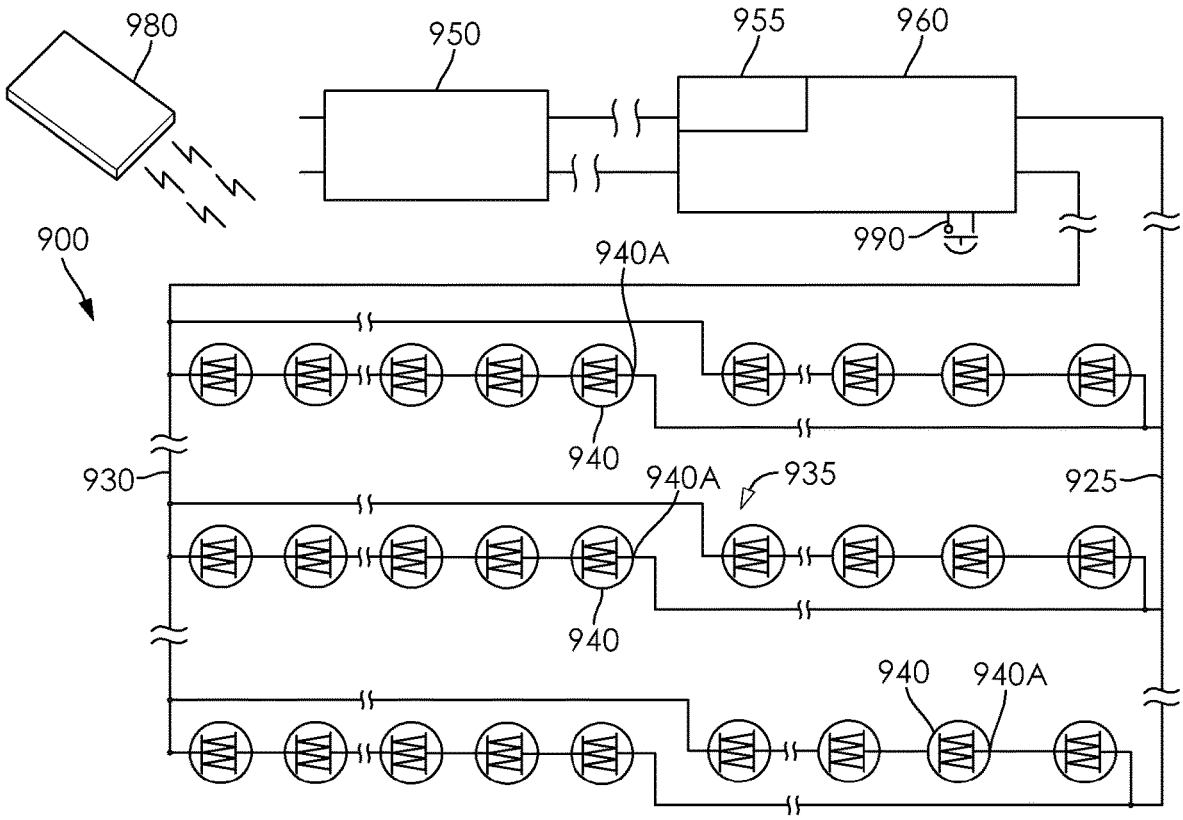
FIG. 9 illustrates a schematic view of at least some exemplary embodiments of the present disclosure.

FIG. 9 illustrates another exemplary electrical configuration of the exemplary disclosed system, apparatus, and method. System 900 may be an electrical system for any of the exemplary disclosed shade or screen assemblies (e.g., shade or screen assembly 105, shade or screen assembly 305, shade or screen assembly 405, shade or screen assembly 505, shade or screen assembly 605, or shade or screen assembly 705). System 900 may include a plurality of conductors 925 and 930 that may be similar to conductors 125 and 130. Conductors 925 and 930 may be for example thin flexible contact strips. System 900 may also include a plurality of electrical components 935 that may be similar to electrical components 135. Electrical components 935 may be connected to conductors 925 and 930 via leads that may be similar to leads 325*a* or 330*a*. Electrical components 935 may be electrically disposed between conductors 925 and 930.

Electrical components 935 may include a plurality of lighting elements 940 that may be similar to any of the exemplary disclosed lighting elements described herein. For example, lighting elements 940 may be multi-color micro-LEDs such as triple color micro-LEDs. Electronics of lighting elements 940 may be disposed in a base 940*a* (e.g., bulb base) of lighting elements 940.

System 900 may include a power source 950 that may be similar to power source 190, a communication component 955 that may be similar to communication component 195, and a control electronics component 960 that may be similar to control electronics component 200. System 800 may also include a controller 980 that may be similar to controller 215.

As illustrated in FIG. 9, system 900 may include electrical components 935 including lighting elements 940 (e.g., 3-color LED bulbs) configured in series relative to each other. Base 940*a* may include electronics in some or all lighting elements 940 that may control a color and/or an intensity of illumination of a given lighting element 940. For example, a desired color or colors for a given lighting element 940 (e.g., bulb) may be controlled (e.g., independently controlled) via the electronics disposed in base 940*a*. Lighting elements 940 may be controlled independently of each other and electrical components 935 (e.g., configured in parallel to each other) may be controlled independently of each other. A number of lighting elements 940 configured in series and in parallel relative to each other (e.g., of an electrical component 935) may be based on an output voltage of power source 950 and/or control electronics component 960. For example in a given electrical component 935 and as illustrated in FIG. 9, a first plurality of lighting elements 940 may be disposed in serial relative to each other, a second plurality of lighting elements 940 may be disposed in serial relative to each other, and the first plurality and the second plurality may be disposed in parallel relative to each other. Control electronics component 960 may control a display provided by lighting elements 940 based on commands received from a user via actuator 990, which may be similar to actuator 210 (e.g., a switch), and/or controller 980. In at least some exemplary embodiments, individual LED colors of lighting elements 940 may be a fixed color so as to provide predetermined (e.g., specific) patterns when the exemplary disclosed output leads are individually energized in a positive or negative direction (e.g., as determined by a manufacturer).

In at least some exemplary embodiments, the exemplary disclosed system, apparatus, and method may incorporate micro-LEDs into rollup shades, rollup awnings, screen-type products for use in the outdoors, and/or any other suitable applications. The exemplary disclosed system, apparatus, and method may include a rollup shade that may be illuminated for outdoor illumination. Display illumination and patterns may be provided by the exemplary disclosed system based on predetermined patterns or algorithms stored and executed by the exemplary disclosed control electronics component and module and/or based on user input and commands received by the system via the exemplary disclosed controller and/or actuator. The exemplary disclosed system, apparatus, and method may include LEDs disposed at (e.g., affixed to) an outdoor shade or screen that may serve to provide shade and/or act as a privacy screen while providing illumination and/or a plurality of illuminated displays. The exemplary disclosed system may be fixed or portable (e.g., including wheels or any other suitable mechanisms for providing portability). The exemplary disclosed system, apparatus, and method may include a shade or screen (e.g., when not illuminated) that may also be used as a screen for projection devices (e.g., projector for television, movies, and any other desired media).

The exemplary disclosed system, apparatus, and method may be used in any suitable application for providing a shade, a screen, a blind, an awning, a canopy, a partition, a room divider, a windbreak, a curtain, a privacy screen, an arras, or any other suitable type of shade or screen assembly. The exemplary disclosed system, apparatus, and method may be used in any suitable type of rollup or roller shade or screen. The exemplary disclosed system, apparatus, and method may be used in any suitable type of outdoor (e.g., or indoor) shade or screen.

An exemplary operation of the exemplary disclosed system, apparatus, and method will now be described. Although the exemplary operation of system 100 as illustrated in FIGS. 1 and 2 will be described, systems 300, 400, 500, 600, 700, 800, and 900 may operate generally similarly.

Lighting elements 140, 140*a*, and 140*b* of electrical components 135 may be powered and controlled by power source 190 and control electronics component 200 via conductors 125 and 130. Control electronics component 200 may control an illumination pattern, sequence, illumination intensity, and/or any other desired operation criteria of lighting elements 140, 140*a*, and 140*b* based on input and user commands received based on controller 215 transferring data to control electronics component 200 via communication component 195, actuator 210, and/or predetermined criteria (e.g., algorithms and/or predetermined sequences of the exemplary disclosed module). Control electronics component 200 may thereby control an operation (e.g., illumination) of lighting elements 140, 140*a*, and 140*b*. Control electronics component 200 may also control elongated member 160 to selectively rotate (e.g., via the exemplary disclosed components described above) to raise and lower member 110.

The exemplary disclosed system, apparatus, and method may provide an efficient and effective technique for providing a relatively thin and/or flexible lighting configuration. For example, the exemplary disclosed system, apparatus, and method may provide a lighting configuration that may be used in rollup shades or screens. The exemplary disclosed system, apparatus, and method may provide a lighting configuration that may be attached to an outdoor shade or screen, which may serve to provide shade or act as a privacy screen while providing illumination and/or illuminated displays.

In at least some exemplary embodiments, the exemplary disclosed apparatus may include a sheet member, a support assembly including a movable, elongated member that is attached to a first end portion of the sheet member, an end assembly attached to a second end portion of the sheet member, and a plurality of lighting devices attached to the sheet member. The plurality of lighting devices may be a plurality of flat panel lighting devices. The plurality of flat panel lighting devices may be a plurality of micro-LEDs. The plurality of flat panel lighting devices may be electrically connected to a control electronics device disposed in the end assembly. The control electronics device may be electrically connected to a power source that is disposed in the end assembly. The control electronics device may be electrically connected to a communication device including a receiver that is disposed in the end assembly. The exemplary disclosed apparatus may include a plurality of strip conductors that are attached to the sheet member, the plurality of lighting devices being electrically connected between the plurality of strip conductors. The plurality of lighting devices may include a first plurality of lighting devices that are disposed in serial relative to each other and a second plurality of lighting devices that are disposed in serial relative to each other, the first plurality and the second plurality being disposed in parallel relative to each other. The plurality of strip conductors may include a first and a second strip conductor disposed at a first side portion of the sheet member and a third and a fourth strip conductor disposed at a second side portion of the sheet member. The plurality of lighting devices may include a first plurality of micro-LEDs disposed between the first strip conductor and the third strip conductor, a second plurality of micro-LEDs disposed between the first strip conductor and the third strip conductor, a third plurality of micro-LEDs disposed between the first strip conductor and the third strip conductor, and a fourth plurality of micro-LEDs disposed between the second strip conductor and the fourth strip conductor. The first plurality of micro-LEDs may be a single parallel-connected micro-LED row, the second plurality of micro-LEDs may be a dual back-to-back parallel-connected micro-LED row, the third plurality of micro-LEDs may be a double-connected parallel-connected back-to-back micro-LED row, and the fourth plurality of micro-LEDs may be a parallel-connected three micro-LED row. The sheet member may include an outer layer that is tinted or opaque. The movable, elongated member may be a rotatable, elongated member configured to roll up the sheet member.

In at least some exemplary embodiments, the exemplary disclosed method may include providing a sheet member including a plurality of flat panel lighting devices, attaching a first end portion of the sheet member to a rotatable member of a support assembly, attaching a second end portion of the sheet member to an end assembly, electrically connecting the plurality of flat panel lighting devices to a control electronics device disposed in the end assembly, and selectively rolling up the sheet member including the plurality of flat panel lighting devices around the rotatable member. The exemplary disclosed method may also include selectively illuminating the plurality of flat panel lighting devices based on the control electronics device controlling the plurality of flat panel lighting devices and selectively projecting an image on the sheet member. The plurality of flat panel lighting devices may be a plurality of micro-LEDs.

In at least some exemplary embodiments, the exemplary disclosed apparatus may include a sheet member that may be a shade or a screen, a support assembly including a rotatable member that is attached to a first end portion of the sheet member, an end assembly attached to a second end portion of the sheet member, and a plurality of micro-LEDs attached to the sheet member. The plurality of lighting devices may be a plurality of flat panel lighting devices. The plurality of micro-LEDs may be electrically connected to a control electronics device disposed in the end assembly. The control electronics device may be electrically connected to both a power source and a communication device including a receiver that may be both disposed in the end assembly. The exemplary disclosed apparatus may also include a canopy of an awning that is rotatably attached to the support assembly. The exemplary disclosed apparatus may further include a support structure that is a planter box or a bench, the support structure supporting selectively extendable members. The end assembly may be attached to the extendable members. The rotatable member may be disposed in or attached to the support structure. The sheet member may include a plurality of slats to which the plurality of micro-LEDs are attached.

While multiple embodiments are disclosed, still other embodiments of the present disclosure will become apparent to those skilled in the art from this detailed description. There may be aspects of this disclosure that may be practiced without the implementation of some features as they are described. It should be understood that some details have not been described in detail in order to not unnecessarily obscure the focus of the disclosure. The disclosure is capable of myriad modifications in various obvious aspects, all without departing from the spirit and scope of the present disclosure. Accordingly, the drawings and descriptions are to be regarded as illustrative rather than restrictive in nature.

What is claimed is:

1. An apparatus, comprising:

a sheet member;

a support assembly including a movable, elongated member that is attached to a first end portion of the sheet member;

an end assembly attached to a second end portion of the sheet member, the second end portion being spaced away from the first end portion; and a plurality of lighting devices attached to the sheet member;

a plurality of strip conductors that are attached to the sheet member, the plurality of lighting devices being electrically connected between the plurality of strip conductors;

wherein the plurality of lighting devices is a plurality of flat panel lighting devices; and wherein the plurality of flat panel lighting devices is electrically connected to a control electronics device disposed in the end assembly.

2. The apparatus of claim 1, wherein the plurality of flat panel lighting devices is a plurality of micro-LEDs.

3. The apparatus of claim 1, wherein the second end portion is disposed on an opposite side of the sheet member as the first end portion.

4. The apparatus of claim 1, wherein the control electronics device is electrically connected to a power source that is disposed in the end assembly.

5. The apparatus of claim 1, wherein the control electronics device is electrically connected to a communication device including a receiver that is disposed in the end assembly.

6. The apparatus of claim 1, wherein the plurality of lighting devices includes a first plurality of lighting devices that are disposed in serial relative to each other and a second plurality of lighting devices that are disposed in serial relative to each other, the first plurality and the second plurality being disposed in parallel relative to each other.

7. The apparatus of claim 1, wherein the plurality of strip conductors includes a first and a second strip conductor disposed at a first side portion of the sheet member and a third and a fourth strip conductor disposed at a second side portion of the sheet member.

8. The apparatus of claim 7, wherein the plurality of lighting devices includes a first plurality of micro-LEDs disposed between the first strip conductor and the third strip conductor, a second plurality of micro-LEDs disposed between the first strip conductor and the third strip conductor, a third plurality of micro-LEDs disposed between the first strip conductor and the third strip conductor, and a fourth plurality of micro-LEDs disposed between the second strip conductor and the fourth strip conductor.

9. The apparatus of claim 8, wherein the first plurality of micro-LEDs is a single parallel-connected micro-LED row, the second plurality of micro-LEDs is a dual back-to-back parallel-connected micro-LED row, the third plurality of micro-LEDs is a double-connected parallel-connected back-to-back micro-LED row, and the fourth plurality of micro-LEDs is a parallel-connected three micro-LED row.

10. The apparatus of claim 1, wherein the sheet member includes an outer layer that is tinted or opaque.

11. The apparatus of claim 1, wherein the movable, elongated member is a rotatable, elongated member configured to roll up the sheet member.

12. An apparatus, comprising:

a sheet member;

a support assembly including a movable, elongated member that is attached to a first end portion of the sheet member;

an end assembly attached to a second end portion of the sheet member, the second end portion being spaced away from the first end portion;

a plurality of flat panel lighting devices attached to the sheet member;

a first strip conductor that is attached to a first side portion of the sheet member; and a second strip conductor that is attached to a second side portion of the sheet member;

wherein the plurality of flat panel lighting devices is electrically connected between the first strip conductor and the second strip conductor.

13. The apparatus of 12, wherein the plurality of flat panel lighting devices is electrically connected to a control electronics device disposed in the end assembly.

14. The apparatus of 12, wherein the second end portion is disposed on an opposite side of the sheet member as the first end portion.

15. An apparatus, comprising:

a sheet member;

a support assembly including a movable, elongated member that is attached to a first end portion of the sheet member;

an end assembly attached to a second end portion of the sheet member, the second end portion being spaced away from the first end portion;

a plurality of flat panel lighting devices attached to the sheet member;

a first plurality of strip conductors that is attached to a first side portion of the sheet member; and a second plurality of strip conductors that is attached to a second side portion of the sheet member;

wherein the plurality of flat panel lighting devices is electrically connected between the first plurality of strip conductors and the second plurality of strip conductors.

16. The apparatus of claim 15, wherein:

the first plurality of strip conductors includes a first and a second strip conductor disposed at the first side portion of the sheet member; and the second plurality of strip conductors includes a third and a fourth strip conductor disposed at the second side portion of the sheet member.

17. The apparatus of claim 16, wherein the plurality of flat panel lighting devices includes a first plurality of LEDs disposed between the first strip conductor and the third strip conductor, a second plurality of LEDs disposed between the first strip conductor and the third strip conductor, a third plurality of LEDs disposed between the first strip conductor and the third strip conductor, and a fourth plurality of LEDs disposed between the second strip conductor and the fourth strip conductor.

18. The apparatus of claim 17, wherein the first plurality of LEDs is a single parallel-connected LED row, the second plurality of LEDs is a dual back-to-back parallel-connected LED row, the third plurality of LEDs is a double-connected parallel-connected back-to-back LED row, and the fourth plurality of LEDs is a parallel-connected three LED row.

19. The apparatus of claim 16, wherein the plurality of flat panel lighting devices is a plurality of micro-LEDs.

* * * * *